United States Patent [19]

Sato

[11] Patent Number: 4,993,854

[45] Date of Patent: Feb. 19, 1991

[54] WIRE DOT PRINT HEAD

[75] Inventor: Takumi Sato, Suwa, Japan

[73] Assignee: Seiko Epson Corporation, Tokyo, Japan

[21] Appl. No.: 450,094

[22] Filed: Dec. 13, 1989

[30] Foreign Application Priority Data

Dec. 19, 1988 [JP] Japan ..... 63-320221
Jan. 10, 1989 [JP] Japan ..... 1-3213
Feb. 1, 1989 [JP] Japan ..... 1-32016

[51] Int. Cl.[5] ..... B41J 2/27; B41J 2/235
[52] U.S. Cl. ..... 400/124; 101/93.05
[58] Field of Search ..... 400/124; 101/93.05

[56] References Cited

U.S. PATENT DOCUMENTS 4,453,840 6/1984 Hodne ..... 400/124

FOREIGN PATENT DOCUMENTS 0141522 5/1985 European Pat. Off. ..... 400/124

*Primary Examiner*—Edgar S. Burr
*Assistant Examiner*—C. A. Bennett
*Attorney, Agent, or Firm*—Blum Kaplan

[57] ABSTRACT

A wire dot printer includes a print head which is more reliable and better controls a gap between a magnetic pole and a print lever. The print head includes a core block and nose block. The core block includes a projection for regulating oscillations of a print lever at its inner central portion. A print lever drive coil for each print lever is formed on the core block about the projection. The nose block includes a disk member which is mounted opposed to the core block. A print lever is movably supported between the nose block and core block.

18 Claims, 9 Drawing Sheets

WIRE DOT PRINT HEAD

BACKGROUND OF THE INVENTION

The present invention relates to wire dot print heads, and in particular, to wire dot print heads containing print levers which are rotatably mounted therein.

Wire dot print heads utilizing print levers are known in the art. Such levers include a print lever having a print wire fixed at one end. A drive coil is positioned adjacent the print lever so that when a pulse current is applied to the drive coil, the print lever rotates causing the print wire projecting from the print lever to print on a recording paper. Additionally, a multistage printer is known in the art from applicant's Japanese Patent Laid Open Application No. 40745/89. The multistage print head includes a plurality of head units as described above built upon each other for high print quality.

In these print heads, the drive coil is disposed on the nose side of the lever to utilize an attraction force for projecting a print wire through the nose end of the print head to effect printing. Because the drive coil is interposed between the nose end of the print head and the lever, the print wire must become unnecessarily long resulting in a corresponding increase in mass, making high speed driving difficult. Additionally, the size of the drive coil must be determined to provide the print wire with a predetermined impact force thus limiting the degree to which the print head may be miniaturized.

The prior art print head was constructed so that a print lever includes a shaft which is supported on a dish-shaped yoke of the driving coil. A damper is provided on a push plate positioned opposite to the drive coil to provide a top oscillation limit for the print lever. Therefore, it becomes difficult to precisely control a gap between a magnetic pole and print lever and the lever stroke cannot be kept constant. Furthermore, the prior art printer utilizes a spring holding member to maintain a coil spring therein for biasing an armature member of the print lever upwards. Therefore, the shape of the holding member becomes quite complicated. Additionally, if the bottom of the spring holding member hole becomes worn out through prolonged use, coil springs will vary in height from one to the other causing diverging outputs. In the multihead embodiment, a highly rigid retainer plate is interposed between adjacent head units. Therefore, the print wire of the farther head units becomes longer causing a disparity in printing operation between units.

Accordingly, it is desired to provide a wire dot print head which overcomes the shortcomings of the prior art.

SUMMARY OF THE INVENTION

Generally speaking, in accordance with the invention, a wire dot print head includes a core block and a nose block. A print lever is formed with an arm member having a print wire extending in a first direction at one end of the member and an armature member facing in a direction counter to the print wire formed at the opposite end of the print lever. The core block is formed with a print lever oscillation regulating projection located at a central portion of the core block. A plurality of magnetic poles are formed within the core block about the oscillation regulating projection. The nose block is formed of a nose for guiding the print wire in a disk member which faces opposite the core block. The print lever is shakably disposed between the core block and the disk member.

Accordingly, it is an object of the invention to provide an improved wire dot print head.

A further object of the invention is to provide a wire dot print head which may realize high speed printing utilizing shortened print wire length and minimizing the moment of inertia of a moving part.

Yet another object of the invention is to provide a miniaturized wire dot print head by maintaining stable print operation through increasing a magnetic attraction force.

Yet another object of the invention is to provide a wire dot print head in which a gap between a magnetic pole and a print lever is precisely controlled.

Yet another object of the invention is to provide a durable wire dot print head for increased use.

Still another object of the invention is to provide a multistage wire dot print head which maintains high print quality while minimizing the number of parts, the difference in print wire length of each stage as well as the variation in the printing operation between stages.

Still other objects of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 11:
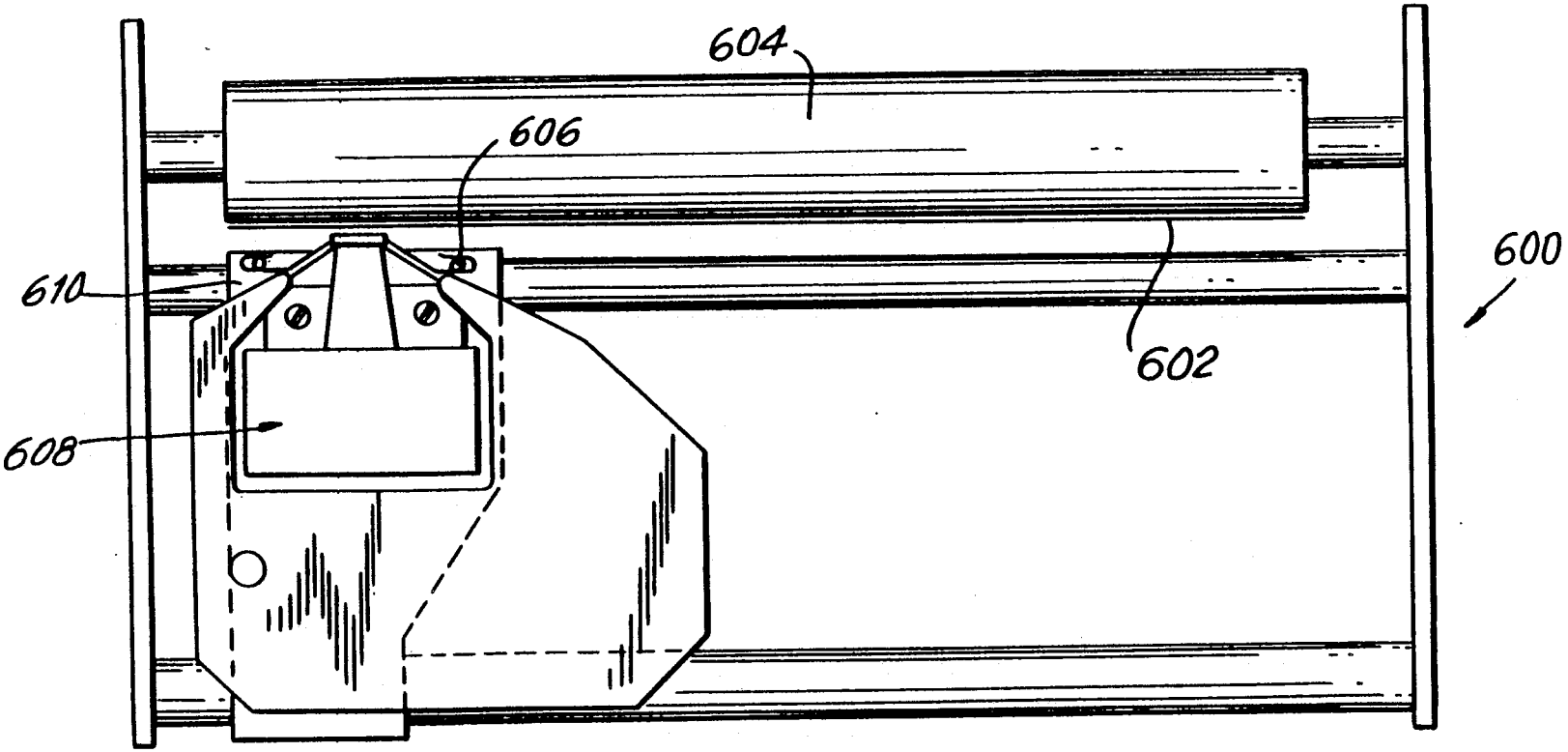
FIG. 11 is a top plan view of printer utilizing a wire dot print head constructed in accordance with the invention.

Reference is first made to FIG. 11 in which a printer, generally indicated as 600, used in conjunction with a wire dot print head, generally indicated as 608, constructed in accordance with the invention is provided. A platen 604 is rotatably supported within printer 600. A carriage 610 is supported within printer 600 and travels in the direction of print columns along platen 604. Wire dot print head 608 is mounted on carriage 610 and moves therewith. The desired patterns, characters and the like are printed on paper 602 positioned between platen 604 and an ink ribbon 606 by wire dot print head 608.

Figure 1:
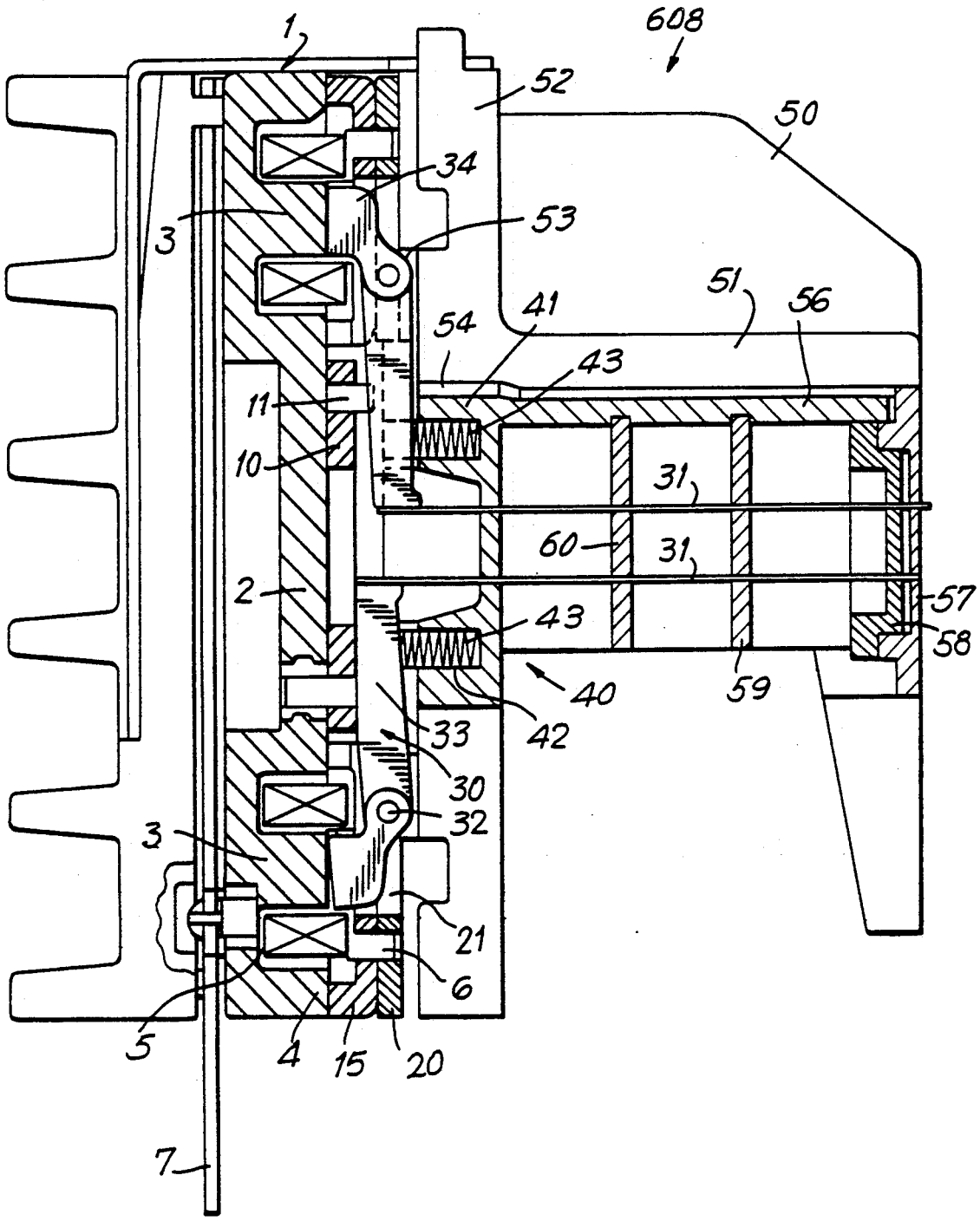
FIG. 1 is a side sectional view of a single stage wire dot print head constructed in accordance with the invention.
Figure 2:
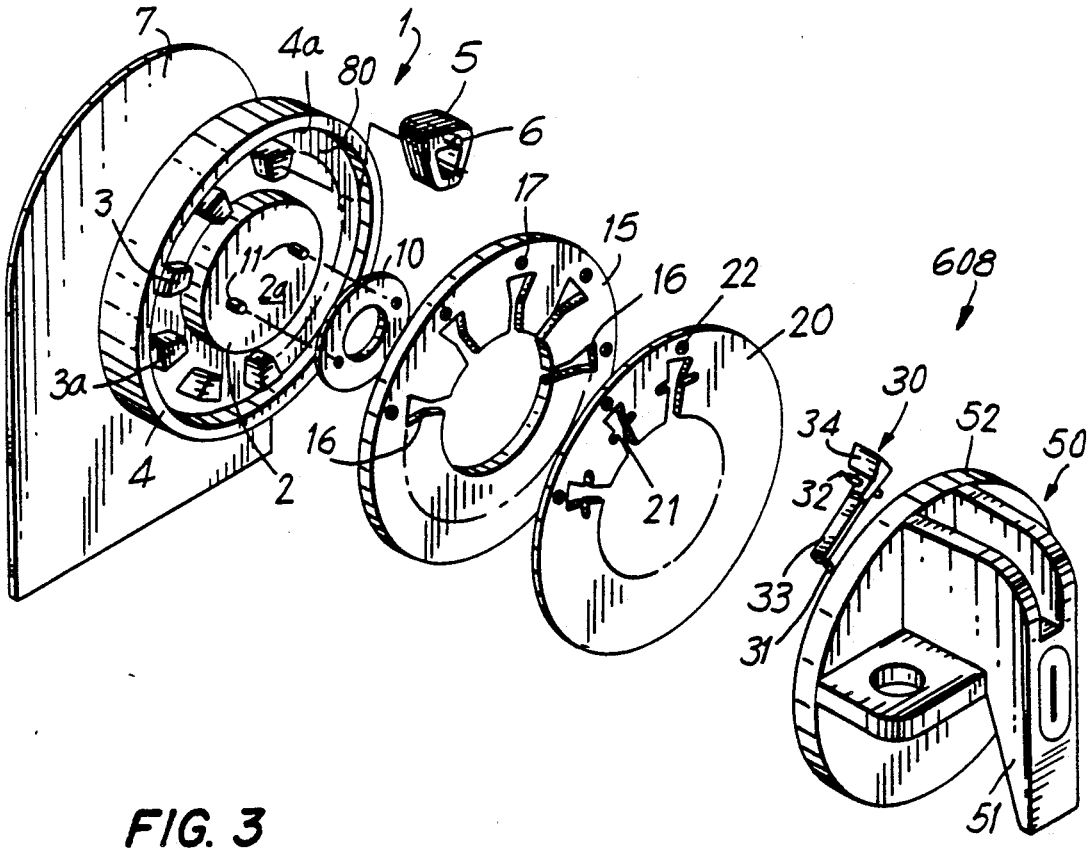
FIG. 2 is an exploded perspective view of a wire dot print head constructed in accordance with the invention.

Reference is now made to FIGS. 1 and 2 wherein a detailed representation of print head 608 is provided. Print head 608 includes a core block 1 and a nose block 50 affixed thereto. A print lever 30 is formed with an arm member 33 and an armature member 34 at one end. A print wire 31 is attached to print arm member 33 at its other end. A spindle 32 is provided at either side of print lever 30 towards the armature member 34 end of arm member 33. A dished yoke 15 supports spindle 32 of print lever at a predetermined height. A disk shaped yoke 20 acts in cooperation with dish shaped yoke 15 to position and support a plurality of print levers 30 radially about core block 1. A spring unit 40 for positioning springs 43 therein to bias arm member 33 is also supported by disk yoke 20 within print head 608. Nose block 50 includes a disk member 52 within which spring unit 40 is also supported and a nose member 51.

Core block 1 is molded from ferromagnetic material such as silicon, steel or the like through a lost wax process, metal injection or the like. A trapezoid shaped projection 2 formed on the front of core block 1 opposite nose block 50 forms a wide plane at the center of core block 1 to regulate oscillation of print lever 30. Core block 1 is formed of an outer peripheral flange 4 leaving a gap 80 between trapezoid projection 2 and peripheral flange 4. A plurality of cores 3 acting as magnetic poles are formed in a ring at regularly spaced intervals within gap 80 about projection 2. The front surface and back surface of core block 1 are precisely ground through simultaneous double grinding so that an upper surface **4*a* of outer peripheral flange 4 provided on the front of an attraction plane 3*a* of each core 3 as well as a top 2*a* of lever oscillation regulating projection 2** are accurately finished to have a co-planar even height.

A circuit board 7 is affixed at the back of core block 1. A coil bobbin 5 is fitted onto respective core 3. An end portion of a coil wound about coil bobbin 5 connects with circuit board 7. Positioning pins are inserted into the top **2*a* of lever oscillation regulating projection 2. A doughnut shaped damper 10 which contacts arm member 33 of print lever 30 to control the movement of print lever 30 is positioned on lever oscillation regulating projection 2 and is maintained in position by positioning pins 11**.

Print lever 30 includes arm member 33 having print wire 31 affixed on one end and an armature member 34 formed at the other end of arm member 33. Armature member 34 is attracted and energized by core 3. Spindle 32 is mounted on print lever 30 towards the armature member 34. One end of arm member 33, the end supporting print wire 31, is formed as a relatively thin portion. The opposed end of arm member 33 which forms armature member 34 is formed as thick as possible beginning at the portion of arm member 33 adjacent spindle 32. Armature member 34 extends in a direction counter to the direction in which print wire 30 extends to be in facing relationship with core 3.

Dish shaped yoke 15 is formed in the shape of a doughnut from a magnetic material to form a portion of a magnetic path in combination with disk yoke 20. Dish shaped yoke 15 is finished by double grinding to provide an accurate thickness to support spindle 32 of print lever 30 at a predetermined height on the front of core block 1. A plurality of slits 16 are provided radially about the circumference of dish shaped yoke 15 to support print lever 30 therein while allowing oscillation of print lever 30.

Disk yoke 20 is provided with a plurality of substantially cross shaped slits 21 radially extending about the circumference to receive print lever 30 including spindle 32 and position print lever 30 opposite a respective core 3. Slit 21 is formed thinner than an outside diameter of spindle 32 to hold spindle 32 when print lever 30 is fit within slit 21 between dish shaped yoke 15 and a projection 53 formed on nose block 50.

Dish shaped yoke 15 is provided with positioning holes 17 formed therein near the top of slit 16. Disk yoke 20 has a similar positioning hole 22 formed at the top of each slit 21. Slits 16 and 21 are positioned one over the other and a dowel 6 extending from a front end of coil bobbin 5 extends through positioning holes 17 and 20 to maintain the proper positioning of dish shaped yoke 15 and disk yoke 20 in place and mounted on core block 1 so that slits 16, 21 correspond to a respective core 3.

Figure 3:
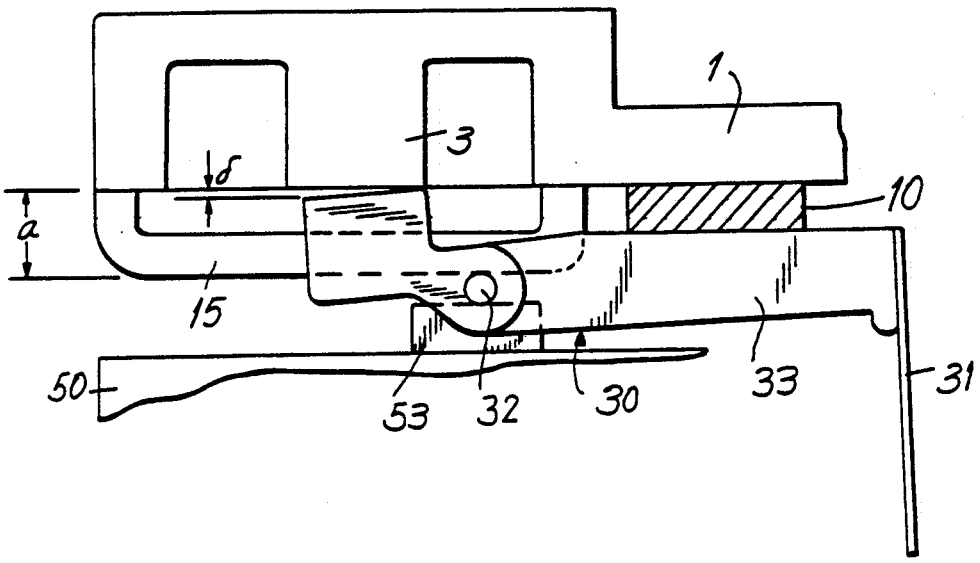
FIG. 3 is a schematic drawing of a print lever supported within the wire dot print head in a holding position in accordance with the invention.

Nose block 50 includes a disk member 52 placed in opposing position to core block 1. A tubular nose member 51 is formed on disk member 52 extending away from core block 1. Disk member 52 is formed with a plurality of projections 53, as shown in FIGS. 1 and 3, in facing relationship with core block 1 for maintaining spindle 32 of lever 30 between projection 53 and dish shaped yoke 15. A plurality of projections 53 are provided in a ring to correspond to each lever 30. A recess 54 is formed within the central portion of nose block 50 for receiving a spring holding member 41. A guide holder 56 is positioned towards nose portion 51 and extends from disk member 54 side of nose block 50 to nose member 51.

Spring holding member 41 is a one-piece unit integrally formed with guide holder 56. A plurality of spring bearing holes 42 corresponding to arm member 33 of each print lever 30 are provided within spring holding member 41. A coil spring 43 is positioned within each spring bearing hole 42 and biases arm member 33 of print lever 30 to come in contact with damper 10. Wire guides 57 and 58 for guiding print wires 21 are mounted at the nose end of guide holder 56 and wire guides 59 and 60 are mounted at a middle portion of guide holder 56 to guide print wire 21 as it slidably moves towards a tip of nose member 51.

Reference is now made to FIG. 3 in which the positioning of lever 30 within print head 608 is provided in greater detail. Print lever 30 is supported at a position which is a fixed height a from the front of core block 1 by dish shaped yoke 15 which has a thickness accurately defined for maintaining lever 30 at that position. Arm member 33 is brought into contact with damper 10 by coil spring 43 from the nose block 50 side of print lever 33 to maintain print lever 33 in a holding state.

Printing lever 30 is precisely controlled in a holding position by core block 1. Dish shaped yoke 15 positioned on core block 1 and having the proper thickness and damper 10 act with armature member 34 of print lever 30 which is in facing relationship with core 3 and separated by an accurate control gap δ to precisely hold lever 30 in this position.

During the holding state, print wire 31 is contained within nose 608. A pulse current is applied to a selected coil wrapped about a core 3. Core 3 attracts armature member 34 across control gap δ. This causes print levers 30 to rotate about spindle 32 at a predetermined angle causing print wire 31 to project through guide 57 of nose member 51 to print.

Figure 4:
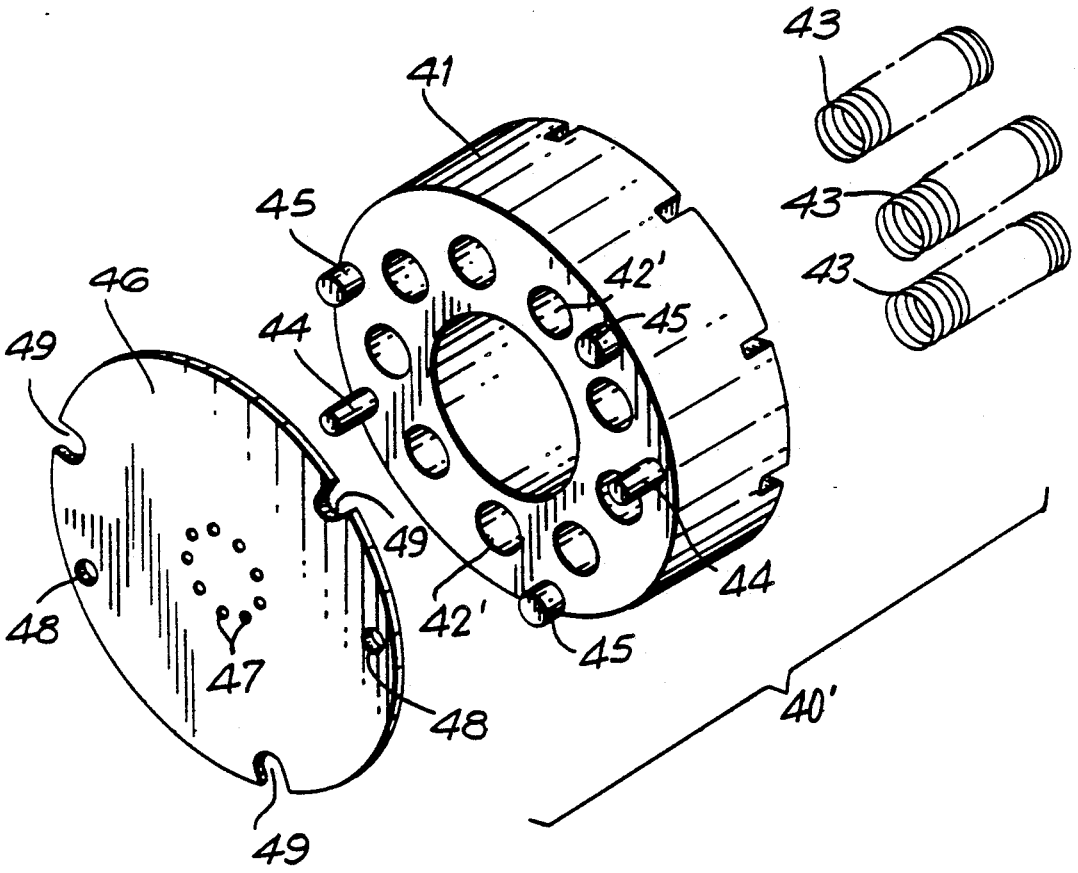
FIG. 4 is an exploded perspective view of a spring unit constructed in accordance with the invention.
Figure 5:
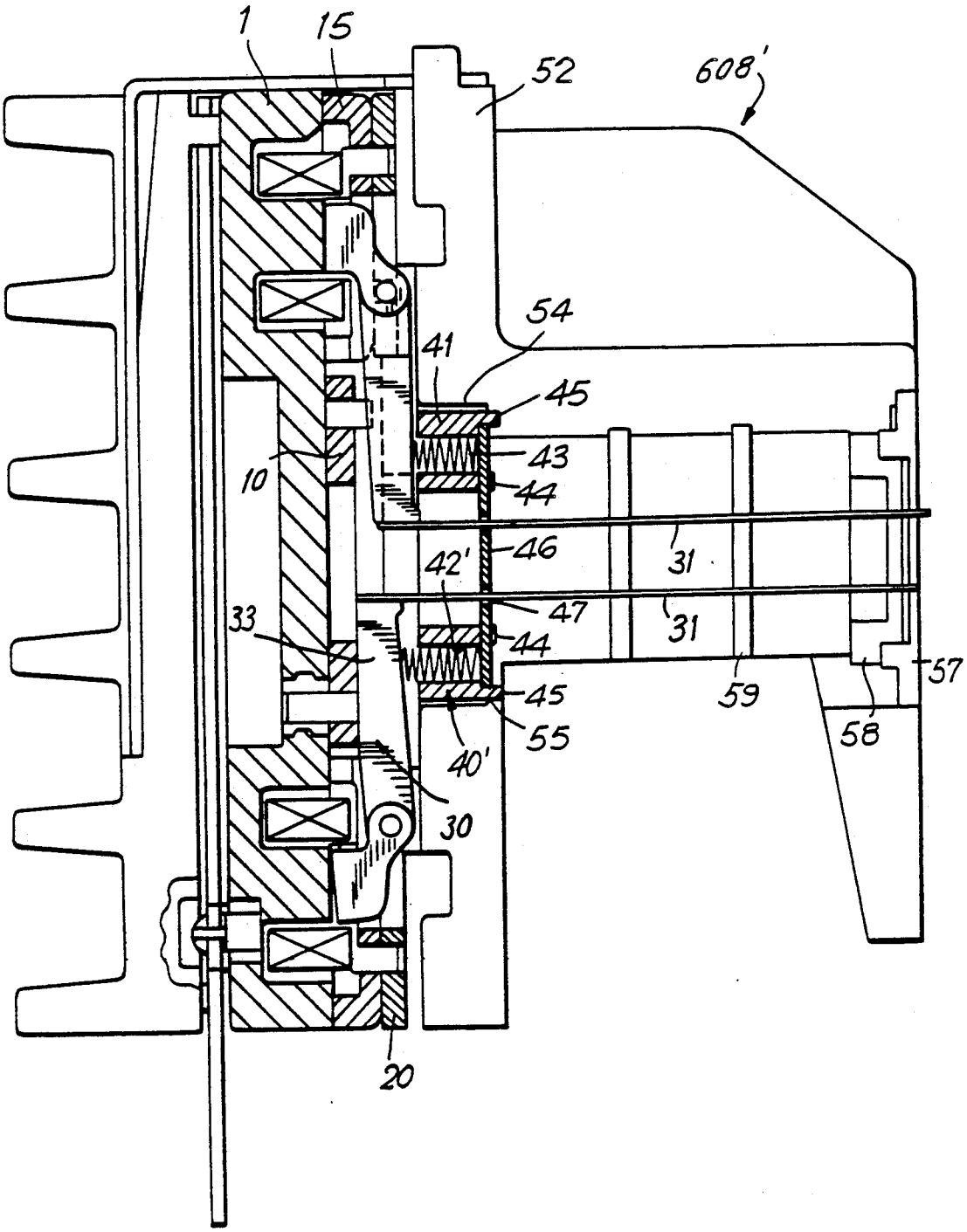
FIG. 5 is a side sectional view of a wire dot print head constructed in accordance with a second embodiment of the invention utilizing the spring unit of FIG. 4.

Reference is now made to FIGS. 4 and in which an exemplary embodiment of a spring unit 40' installed in a second embodiment of the print head, generally indicated as 608', is provided. Spring holder member 40' is similar to spring holder 40, the primary difference being the spring holes and non unitary construction. Accordingly, like elements are indicated by like numerals. Spring unit 40' includes a tubular spring holding member 41 formed of a moldable plastic or the like in the shape of a cylinder having a height capable of fitting into a recess 54 on the front of disk member 52 of nose block 50. Spring unit 40 also includes a plate shaped spring bearing seat 46. Spring holding member 41 is formed with a plurality of through holes 42' forming concentric circles at regular spaced intervals for containing and holding spring 43 therein. A pair of fixing dowels 44 extending from spring member 41 are received by positioning holes 48 within seat member 46 to position seat member 46 on spring holding member 41. Three positioning dowels 45 extend from the surface of spring holding member 41 and pass through notches 49 formed at the outer circumference of seat member 46 and are received in a positioning hole 55 provided in the fitting recess 54 of disk member 52. Positioning dowels 45 are provided at regular spaced intervals about the circumference of spring holding member 41.

Spring bearing seat 46 is formed of a high wear resistant material such as carbon steel which is hardness enhanced by quenching and tempering after press working, ceramics, FRP having a high wear resistance or the like. Spring bearing seat 46 is formed of a plate like member having a planar shape corresponding substantially to that of spring holding member 41. A plurality of guide holes are formed at the center of seat member 46 for slidably guiding print wire 31.

Spring unit 40' is formed into a single unit by bringing spring bearing seat 46 into contact with the end surface of the fitting side of spring holding member 41. Fixing dowels 44 are inserted in holes 48 and the nose of dowel 44 is then caulked. Next, the unified spring unit 40 is fit into fitting recess 54 provided within disk member 52 of nose block 50 and is firmly fixed by matching positioning dowel 45 projecting from the end surface of spring holding member 41 with positioning holes 55 provided in fitting recess 54. Coil spring 43 is positioned through hole 42' along with a oily high viscous liquid. Each arm member 33 of print lever 30 is brought into contact with a respective coil spring 43.

Spring holding member 41 which is complicated in shape and almost free from load working and spring bearing seat 46 which is formed as a simple shape and subjected to repeated load working may be molded separately utilizing easily molded plastic material and a material with high wear resistance, respectively. Then, since the wear resulting in the bottom portion of spring insertion hole 42' and wire guide hole 47 can be prevented since it is made from the high wear resistant material, the fluctuation of the load working on the coil spring 43 and energy loss due to bends in printing wire 31 may be prevented.

Figure 6:
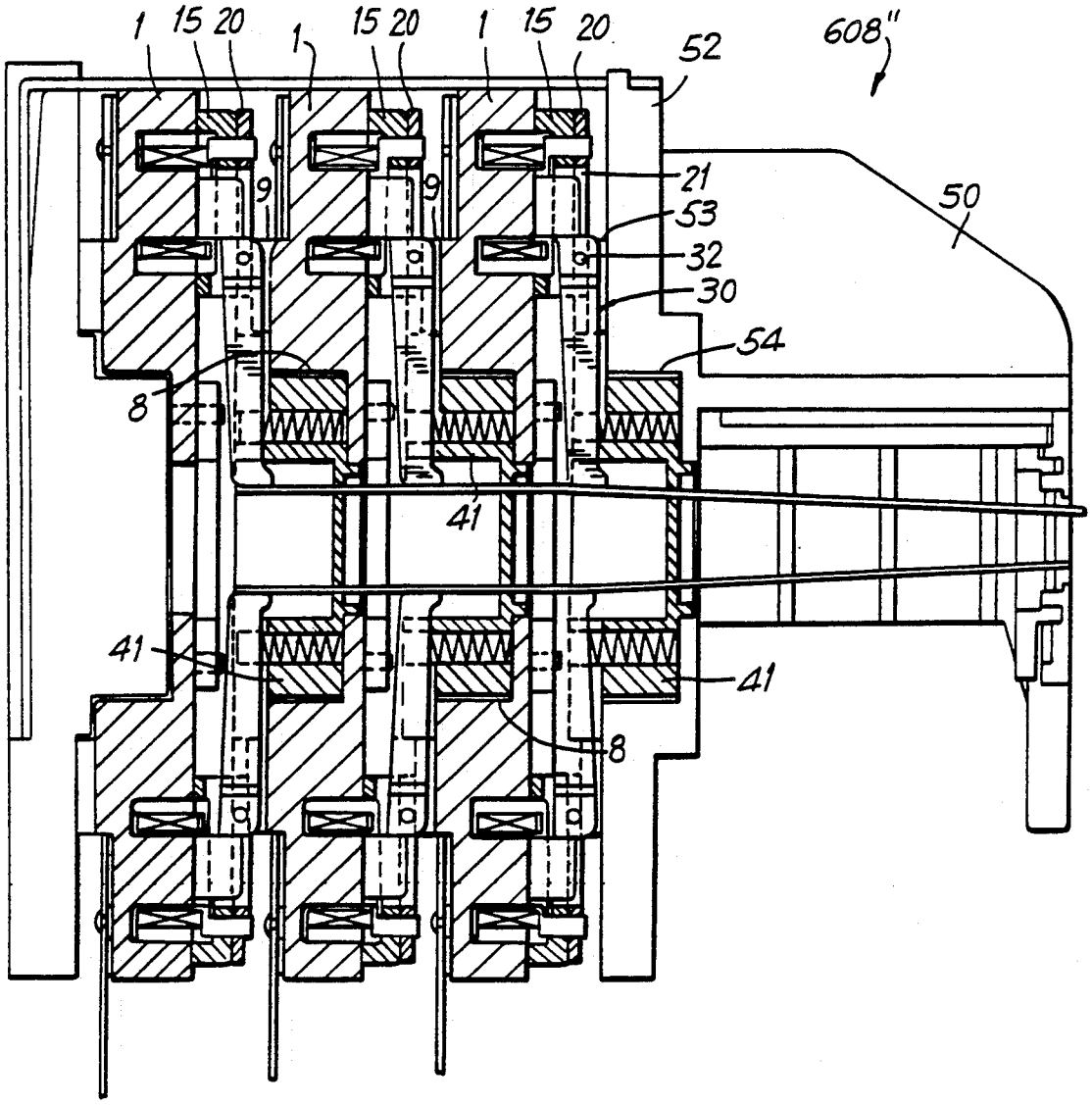
FIG. 6 is a side sectional view of a multistage wire dot print head constructed in accordance with a third embodiment of the invention.
Figure 7:
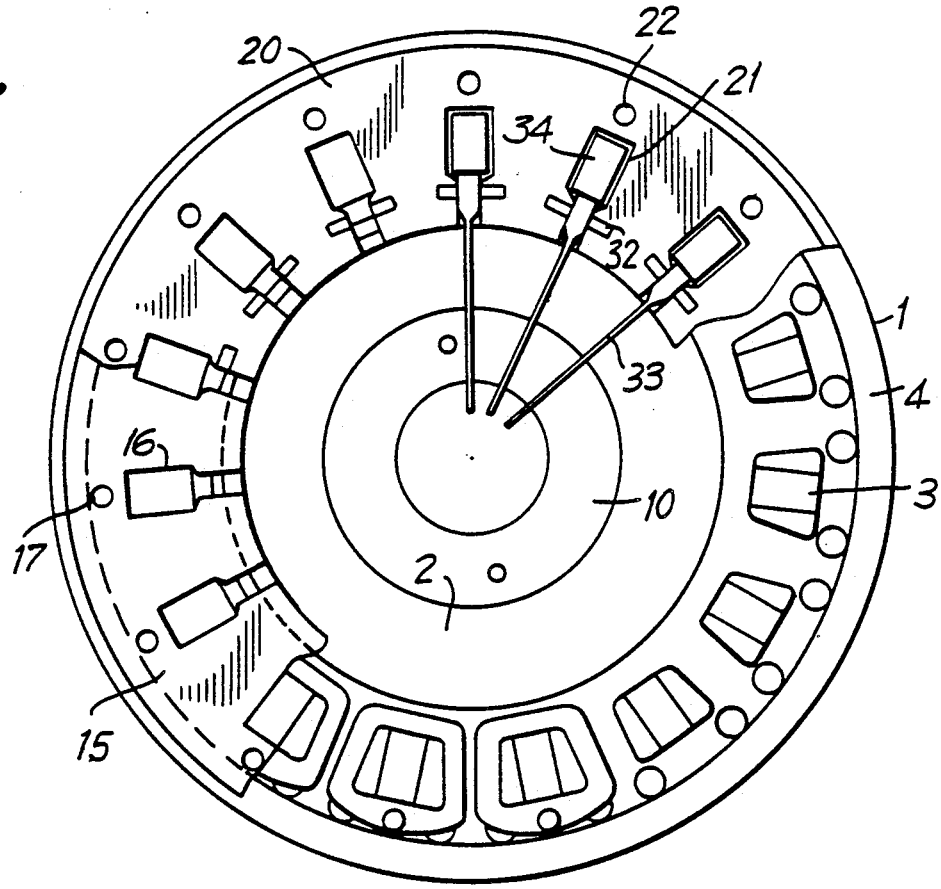
FIG. 7 is a partial top plan view of a core block assembly of the print head constructed in accordance with the third embodiment of the invention.
Figure 8:
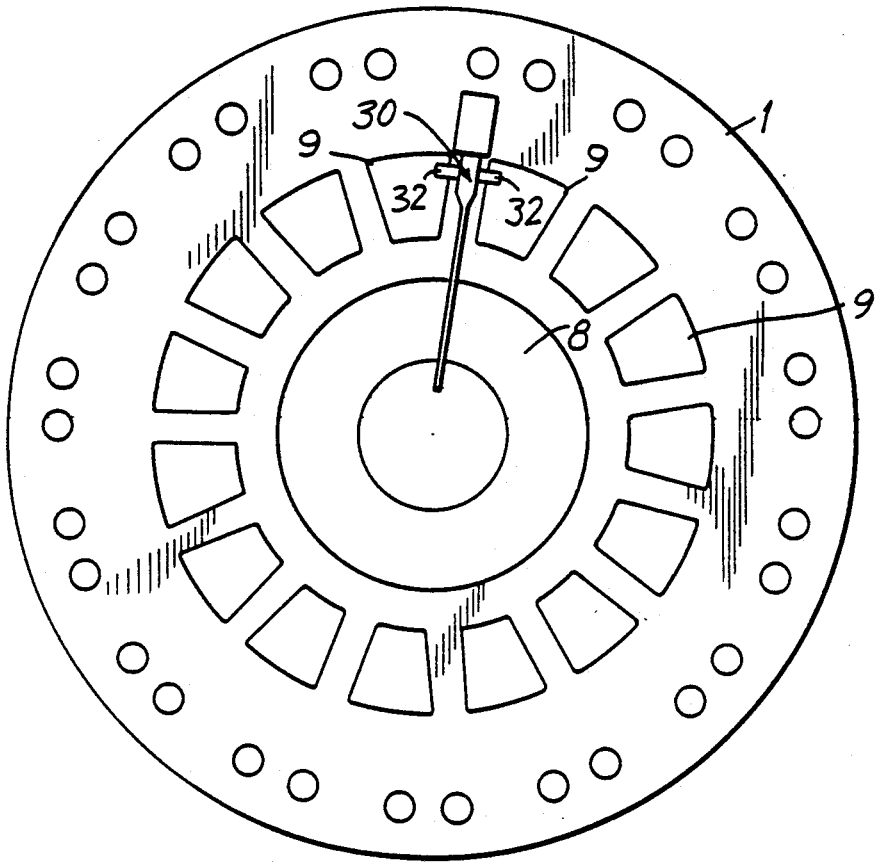
FIG. 8 is a bottom plan view of the nose block constructed in accordance with the third embodiment of the invention.

Reference is now made to FIGS. 6–8 wherein a multistage wire dot print head, generally indicated as 608'', constructed in accordance with the invention is provided. Wire dot print head 6O8'' is essentially identical to wire dot print head 608', the difference being the stacking of core blocks 1 upon each other. Accordingly, like numerals are utilized to indicate like structure.

Core block 1 of each stage of multistage wire dot print head 608'' has a fitting recess 8 positioned at the central portion of core block 1 for receiving the spring holding member 41 of the next stage of wire dot print head 608''. A plurality of projections 9 extending from core block 1 at spaced intervals forming a ring about fitting recess 8 support spindles 32 of print lever 30 therebetween. To construct multistage wire dot print head 608'', first a spring holding member 41 of the first stage is fit in fitting recess 54 provided within a central portion of disk member 52 of nose block 50 as is done when constructing single stage wire dot print head 608'. Disk yoke 20 is placed within disk member 52. Each print lever 30 is fitted into each positioning slot 29 provided on disk yoke 20 and the dish shaped yoke 15 is placed thereon. Spindles 32 of print lever 30 are held between projection 53 provided on the inside surface of disk member 52 and dish shaped yoke 15. The next core block I is placed on the first stage. The respective print head units of the second and third stages are then built up thereafter. Projection 53 replaces projection 9.

Figure 9:
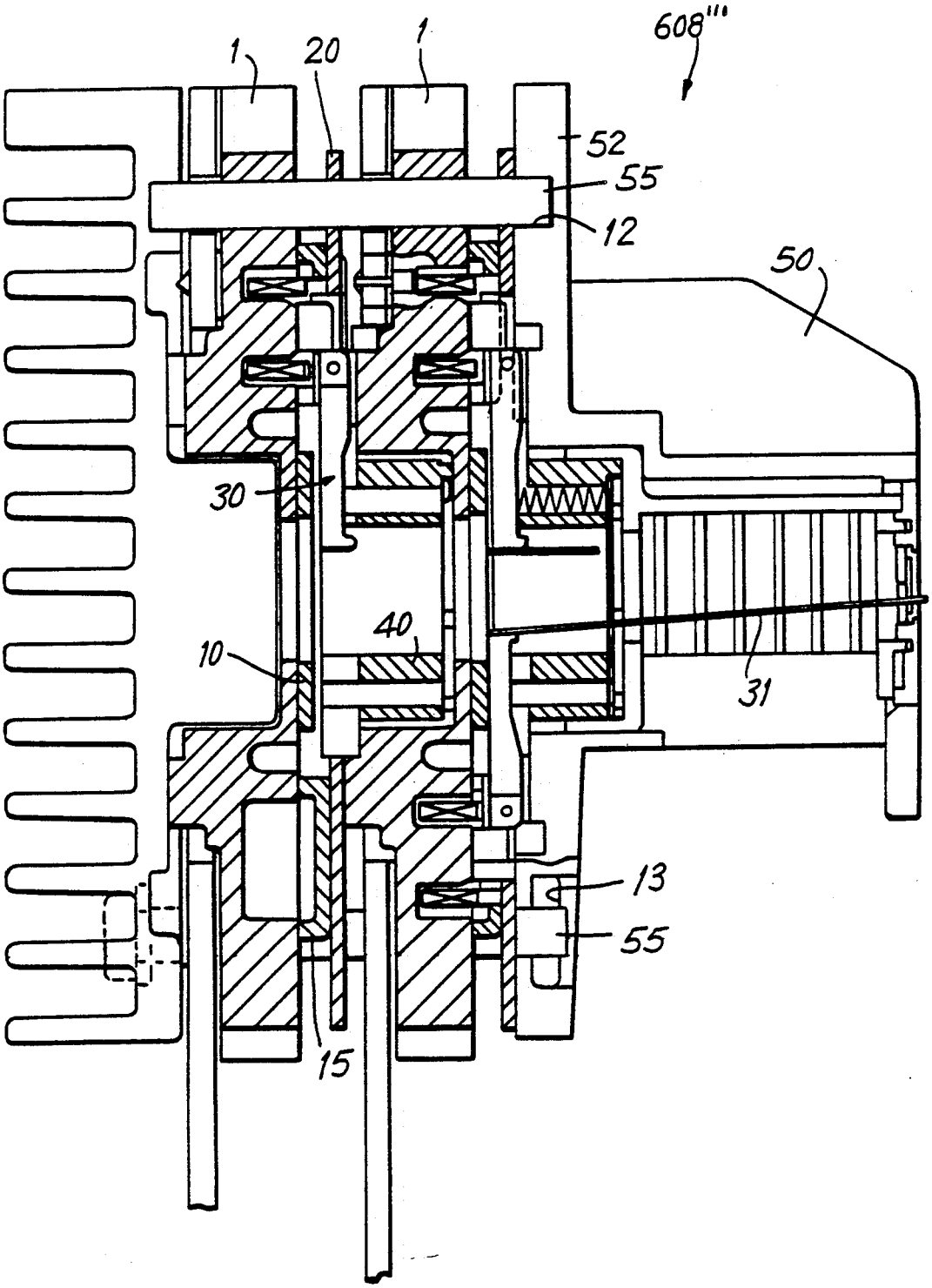
FIG. 9 is a side sectional view of a multistage print head constructed in accordance with the fourth embodiment of the invention.
Figure 10:
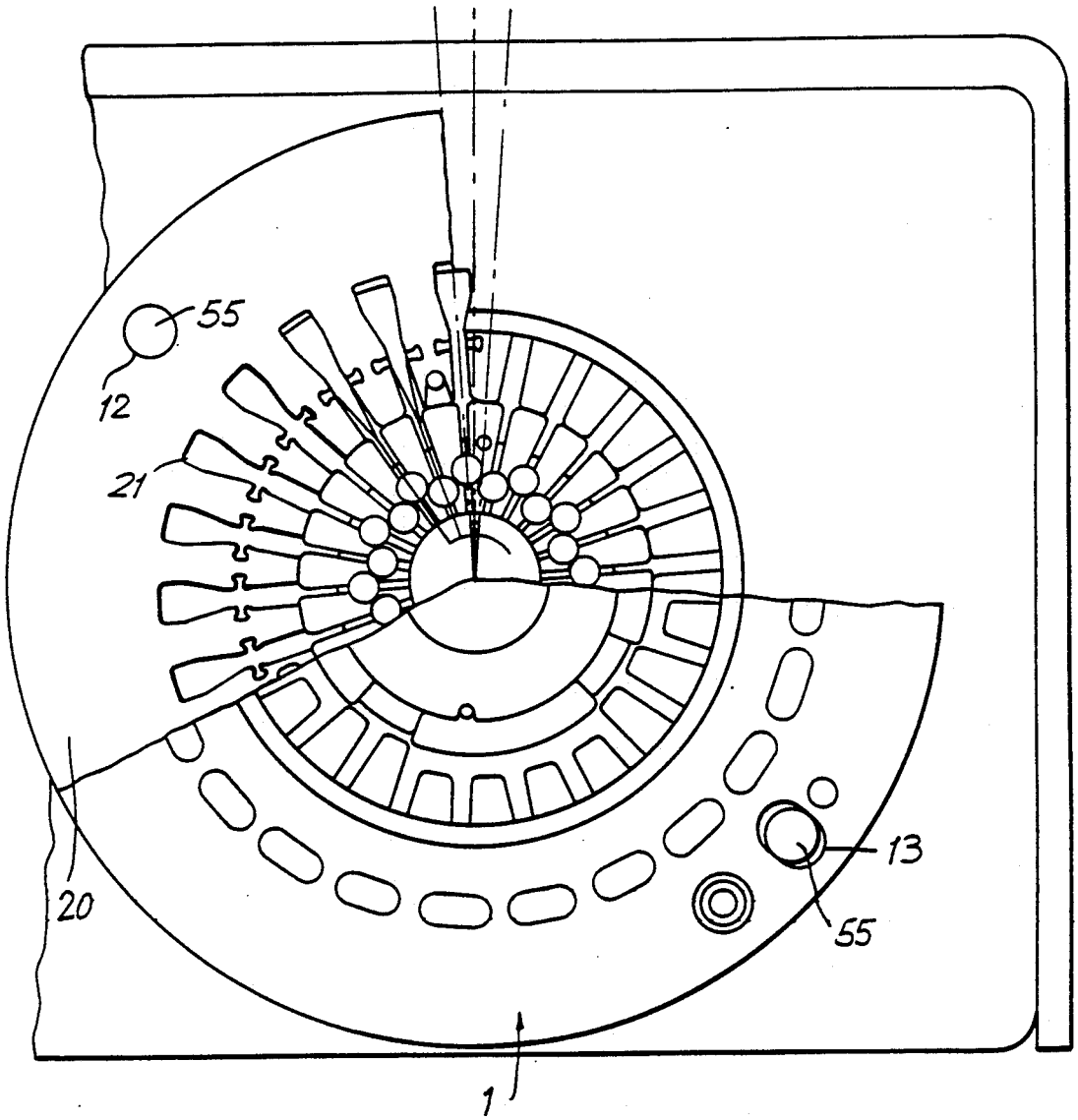
FIG. 10 is a partial sectional top plan view of a multistage print head constructed in accordance with a fifth embodiment of the invention.

Reference is now made FIGS. 9 and 10 in which a multistage wire dot print head, generally indicated as 608''' is provided. Wire dot print head 608''' is similar to that to wire dot print head 608'', the essential difference being the utilization of a positioning rod for aligning respective stages of the wire dot print head. Accordingly, like numerals are utilized to designate like parts. A circular hole 12 and an elliptical hole 13 are formed on each core block 1 of each stage. Positioning rods 55 extend from disk member 52 of nose block 50. Positioning rods 55 are fitted in circular hole 12 and elliptical hole 13 of core block 1 for accurately positioning the respective stages of wire dot print head 608''' relative to each other.

In wire dot print head 608''', print lever 30 is directly positioned on nose block 50. Successive print levers of the next stages are positioned directly on the core block I of the preceding stage. Therefore, the difference in length of print wire 31 for each stage is sharply reduced and the diversity of printing operation between stages can be minimized.

By providing a wire dot print head in which a print lever has an arm member with a print wire fixed at one end and an armature member positioned at the other end extending in a reverse direction than the print wire and positioning the print lever between a nose block and a core block, the print wire may be shortened in length to a thickness of a core block and high speed printing will be realized. Additionally, by positioning the drive coil at the outside of the core block a larger drive coil may be mounted within the wire dot print head or miniaturization of the entire print head may be realized utilizing the same sized coil as in the prior art.

By constructing the wire dot print head having a surface of the magnetic pole, a top of the print head oscillation regulating projection in an upper surface of the outer peripheral flange of the core block being formed in the same plane, providing a dish shaped yoke and a damper formed to a predetermined thickness and placing the dish shaped yoke and damper on the upper surface of the outer peripheral flange and the top of the lever oscillation regulating projection, a gap between magnetic pole and the print lever may be accurately controlled.

Additionally, by providing a unit for retaining the coil spring for energizing the print head having a spring holding member provided with a through hole for inserting the coil spring therein and a plate like spring bearing member formed of a wear resistant material which is attached at one end of the spring holding member, wear of the spring bearing member is prevented and durability is enhanced. Additionally, a difference in the level of the spring bearing surface is now removed and the height of the coil spring is always kept constant. This minimizes the disparity of outputs between print levers.

By providing a multistage wire dot print head in which projections for holding the print lever therebetween a high quality of wire dot print heads constructed with a minimum number of parts is provided. Additionally, the difference in the length of printing wires of each stage is minimized thereby minimizing the diversity in printing operation between the respective stages.

It will thus be seen that the objects set forth above, among those made apparent from the preceding description, are efficiently attained and, since certain changes may be made to the above constructions without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A wire dot printer including a wire dot print head comprising a core block having a print lever oscillation regulating projection formed at a central portion of said core block and a plurality of magnetic poles formed at regular spaced intervals about said print lever oscillation regulating projection, a plurality of print levers each having an arm member, a print wire supported at one end of said arm member and an armature formed at a second end of said arm member, a nose block having a nose for guiding said print wire and a disk member disposed opposite said core block, a disk shaped yoke, disposed on said core block, having at least one positioning slit for positioning the print lever therein and said print lever having said armature projecting from said arm member toward said core block being movably disposed between said core block and said disk member.

2. The wire dot printer of claim 1, wherein said arm member of said print lever includes a pivotal member and is formed thin at said one end and the armature member is provided at an opposed side of said pivotable member and said second end and is formed as a thick member.

3. The wire dot printer of claim 1, further comprising a damper coming in contact with said one end of said print lever, a print lever biasing means for positioning the arm member of the print lever on the damper having a spring holding member with a hole formed therein at a central portion for guiding the print wire and a plurality of through holes formed about said hole of said spring holding member for receiving a coil spring therein for biasing said print lever, and a plate shaped spring bearing member formed of a wear resistant material and affixed at one end of said spring holding member.

4. The wire dot printer of claim 3, wherein said spring holding member is molded from a moldable material.

5. The wire dot printer of claim 3, wherein a plurality of guide holes for guiding the print wire are centrally formed in said spring bearing member.

6. The wire dot printer of claim 3, wherein said spring holding member includes an end portion and further comprising a projection formed on said end portion of said spring holding member, said spring bearing member receiving said projection to be positioned on said spring holding member.

7. The wire dot printer of claim 1, further including a wire dot print head comprising at least a second core block, each core block having a peripheral edge portion and the plurality of magnetic poles provided at a central portion of one face of said core blocks, a pivotable member formed on said print lever between said armature and said print wire, a print lever pivotable member holding projection formed at a peripheral edge of a second face of said core block, said at least second core block being built up upon each other and said second core block being built upon said core block and said print levers being movably supported between said core blocks by said lever pivotable member holding projection and said first core block being built up upon said nose block said plurality of print levers being movably positioned between said disk member and said core block.

8. The wire dot printer of claim 7, wherein a central portion of said disk member is formed with a recess therein for receiving a print lever biasing unit at a central portion of said second face of each core block.

9. The wire dot printer of claim 7, wherein at least two positioning rods are formed on an inner peripheral edge portion of said disk member, and a rod insertion hole formed on the peripheral edge portion of each core block for receiving said positioning rods, said each core block of said at least two core blocks being positioned and built upon said disk member by said positioning rods.

10. A wire dot printer including a wire dot print head comprising a core block having a print lever oscillation regulating projection formed at a central portion of said core block and a plurality of magnetic poles formed at regular spaced intervals about said print lever oscillation resulting projection, a plurality of print levers each having an arm member, a print wire supported at one end of said arm member and an armature formed at a second end of said arm member, a nose block having a nose for guiding said print wire and a disk member disposed opposite said core block, and said print lever being movably disposed between said core block and said disk member, an attraction face formed on said magnetic poles, said core block further including an outer peripheral flange, a top surface of said oscillation regulating projection and an upper surface of said outer peripheral flange being co-planar, a dish shaped yoke having a thickness for regulating a working height of said print levers and a disk shaped yoke having at least one positioning slit for positioning the print lever therein being built upon said dish shaped yoke and positioned on the outer peripheral flange, and a damper coming in contact with said one end of said print lever disposed on said oscillation regulating projection.

11. A wire dot printer including a wire dot print head comprising a core block having a print lever oscillation regulating projection formed at a central portion of said core block and a plurality of magnetic poles formed at regular spaced intervals about said print lever oscillation regulating projection, a plurality of print levers each having an arm member, a print wire supported at one end of said arm member and an armature formed at a second end of said arm member, a nose block having a nose for guiding said print wire and a disk member disposed opposite said core block, and said print lever being movably disposed between said core block and said disk member, a disk shaped yoke, said nose block including a peripheral edge portion, said nose block being formed with a recess provided at a central portion of said disk member for receiving a print lever biasing unit, and further comprising a pivotable member formed on each said print lever and a projection formed on the peripheral edge portion of said nose block for holding said pivotable member of said print levers thereon in cooperation with said disk shaped yoke.

12. A wire dot printer comprising a plurality of print levers each having an arm member, a print wire supported at one end of each said arm member and an armature formed at a second end of each of said arm member, a damper coming in contact with said one end of said print levers, print lever biasing means for positioning the arm members of the print levers on the damper having a spring holding member with a hole formed therein at a central portion for guiding the print wire and a plurality of through holes formed about said hold of said spring holding member for receiving a coil spring therein for biasing said print levers, and a plate shaped spring bearing member formed of a highly wear resistant material and affixed at one end of said spring holding member.

13. The wire dot printer of claim 12, wherein said spring holding member is molded from a moldable material.

14. The wire dot printer of claim 12, wherein a plurality of guide holes for guiding the print wire are centrally formed in said spring bearing member.

15. The wire dot printer of claim 12, wherein said spring holding member includes an end portion and further comprising at least one projection formed on said end portion of said spring holding member, said spring bearing member receiving said projection to be positioned on said spring holding member.

16. A wire dot printer including a wire dot print head comprising a plurality of core blocks, a nose block having a disk member, each core block having a print lever oscillation regulating projection formed at a central portion of each said core block, a peripheral edge portion and a plurality of magnetic poles provided at a central portion of one face of each said core block, a plurality of print levers each having an arm member, a print wire supported at one end of each said arm member and an armature formed at a second end of each said arm member, a pivotable member formed on said print levers between said armature and said print wire, a print lever pivotable member holding projection formed at a central portion of a second face of each said core block, said plurality of core blocks being built up upon each other and said print levers being movably supported between a respective two of said plurality of core blocks by said lever pivotable member holding projection and a first core block of said plurality of core blocks being built up upon said nose block, said plurality of print levers being movably positioned between said disk member and a respective core block of said plurality of core blocks.

17. The wire dot printer of claim 16, wherein a central portion of an inner region of said disk member is formed with a recess therein for receiving a print lever energizing unit at a central portion of said second face of each said core block.

18. The wire dot printer of claim 16, wherein at least two positioning rods are formed on a peripheral edge portion of said disk member, and a rod insertion hole is formed on the peripheral edge portion of each said core block for receiving said positioning rods, said each core block of said plurality of core blocks being positioned and built upon said disk member by said positioning rods.

* * * * *